United States Patent [19]

Mizuno et al.

[11] 4,278,862

[45] Jul. 14, 1981

[54] COMBINATION MICROWAVE AND GAS OVEN

[75] Inventors: Sueo Mizuno, Nagoya; Toshihiro Nozu, Aichi; Yoshihiro Kanaya; Masahiko Koumura, both of Konan, all of Japan

[73] Assignee: Rinnai Kabushiki Kaisha, Nagoya, Japan

[21] Appl. No.: 113,040

[22] Filed: Jan. 17, 1980

[30] Foreign Application Priority Data

Jan. 25, 1979 [JP] Japan ..... 54-7100[U]

[51] Int. Cl.[3] ..... H05B 6/68

[52] U.S. Cl. ..... 219/10.55 B; 219/10.55 R; 219/10.55 C; 219/508; 219/400; 126/21 A; 126/273 R; 307/115

[58] Field of Search ..... 219/10.55 B, 10.55 R, 219/10.55 D, 10.55 C, 10.55 E, 400, 508, 509; 126/273 R, 273 A, 21 R, 21 A, 275 E, 19 R, 39, 39 BA, 39 C, 197; 307/113, 115, 41

[56] References Cited

U.S. PATENT DOCUMENTS 4,132,878 1/1979 Tachikawa et al. ..... 219/10.55 B 4,198,553 4/1980 Dills ..... 219/10.55 B 4,211,909 7/1980 Yoshida et al. ..... 219/10.55 R

*Primary Examiner*—Gene Z. Rubinson

*Assistant Examiner*—Philip H. Leung

*Attorney, Agent, or Firm*—Haseltine and Lake

[57] ABSTRACT

A cooking device with a microwave heater and a gas heater as well as a cooling fan for the microwave heater. A first circuit operates the microwave heater and is connected to a source of electric power through a first switching circuit. A second circuit operates the gas heater and is connected to the electric source of power through a second switching circuit, as well as a switch arranged to be operated with a gas cock. A driving circuit for the cooling fan is connected to that switch so as to be parallel with a circuit connecting in series the second circuit and the second switching circuit. The switch, furthermore, has a first contact connected to the electric source of power through the first switching circuit and has a second contact connected to the source of power without passing through the first switching circuit, while being arranged to be connected to the first contact when the gas cock is closed and to the second contact when the gas cock is opened.

7 Claims, 3 Drawing Figures

COMBINATION MICROWAVE AND GAS OVEN

BACKGROUND OF THE INVENTION

This invention relates to a heat cooking device of the type that a cooking device main body having therein a heating chamber is provided with a microwave heating means, a gas heating means and a cooling fan for cooling the microwave cooking means.

It has been usual heretofore with this kind of cooking device, that a first operation circuit for operating the microwave heating means is connected to an electric power source through a first switching circuit, and a second operation circuit for operating the gas heating means is connected to the electric power source through a second switching circuit and a switch which is arranged to be operated with a gas cock, so that the microwave heating means and the gas heating means may be operated at discretion solely or jointly by operation of the first switching circuit and by operation of the second switching circuit, respectively. In this case, for protecting the microwave heating means from heat of the interior of the heating chamber, the cooling fan is desirable to be driven not only when the microwave heating means is operated, but also when the gas heating means is operated. For meeting this requirement, it has been usual heretofore that a driving circuit for the cooling fan is connected to the electric power source through a pair of relay switches which are in parallel one with another and are arranged to be respectively closed by closing of the respective switch circuits. This arrangement, however, is inconvenient in that the device becomes complicated in construction because the respective switching circuits require respective relay circuits.

SUMMARY OF THE INVENTION

A cooking device in which a first operation circuit operates a microwave heater connected to an electric power source through a first switching circuit. A second operation circuit operates a gas heater connected also to the electric power source but through a second switching circuit and a switch arranged to be operated with a gas cock. A driving circuit for a cooling fan is connected to the switch so as to be parallel with a circuit connecting in series the second operation circuit and the second switching circuit.

Recording to the present invention, furthermore, the switch is constructed with a first contact connected to the electric source of power and through the first switching circuit. The switch has, moreover, a second contact connected to the electric power source without passing through the first switching circuit, while being arranged to be connected to the first contact when the gas cock is closed and to the second contact when the gas cock is opened.

The microwave heater and the cooling fan are located on the upper side of a heating chamber, and the gas heater is in the form of a gas burner on the lower side of that heating chamber.

The novel features which are considered as characteristic for the invention are set forth in particular in the appended claims. The invention itself, however, both as to its construction and its method of operation, together with additional objects and advantages thereof, will be best understood on the following description of specific embodiments when read in connection with the accompanying drawings.

DESCRIPTION OF THE PREFERRED EMBODIMENTS

Figure 1:
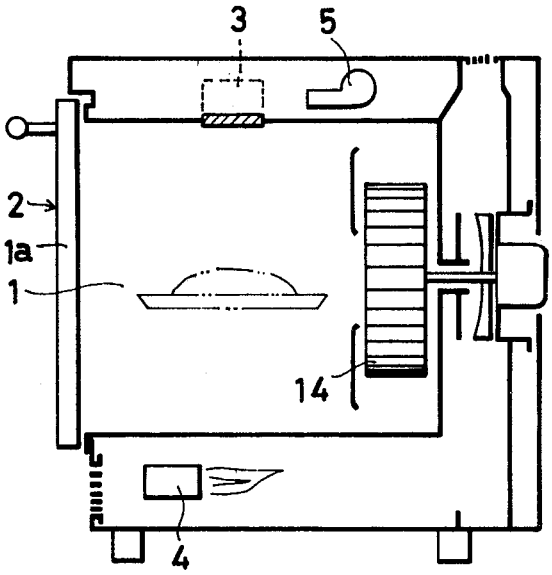
FIG. 1 is a sectional side view of one embodiment of the cooking device according to the present invention.

This invention has for its object to provide a cooking device which is free from inconvenience. There is provided a cooking device of the type that a cooking device main body 2 having therein a heating chamber 1 is provided with a microwave heating means 3, a gas heating means 4 and a cooling fan 5 for the microwave heating means 3. A first operation circuit 6 for operating the microwave heating means 3 is connected to an electric power source 8 through a first switch circuit 7, and a second operation circuit 9 for operating the gas heating means 4 is connected to the electric power source 8 through a second switching circuit 10 and a switch 12 arranged to be operated with a gas cock 11. A driving circuit 13 for the cooling fan 5 is connected to the switch 12 so as to be in parallel with a circuit connecting in series the second operation circuit 9 and the second switch circuit 10. The switch 12 is constructed to be such a changeover type one, that the same has a first contact **12*a* connected to the electric power source 8 through the first switch circuit 7 and a second contact 12*b* connected to the electric power source 8 without passing through the first switch circuit 7. It is arranged to be connected to the first contact 12*a* when the gas cock 11 is closed and to the second contact 12*b* when the gas cock 11** is opened.

As shown in FIG. 1, for instance, the cooking device main body 2 is so constructed that the microwave heating means 3 and the cooling fan 5 for cooling the same are provided on the upper side of the heating chamber 1. The gas heating means 4 comprises a gas burner provided on the lower side of the heating chamber 1, and a circulation fan 14 for circulating air in the chamber 1 is provided in the heating chamber 1.

Figure 2:
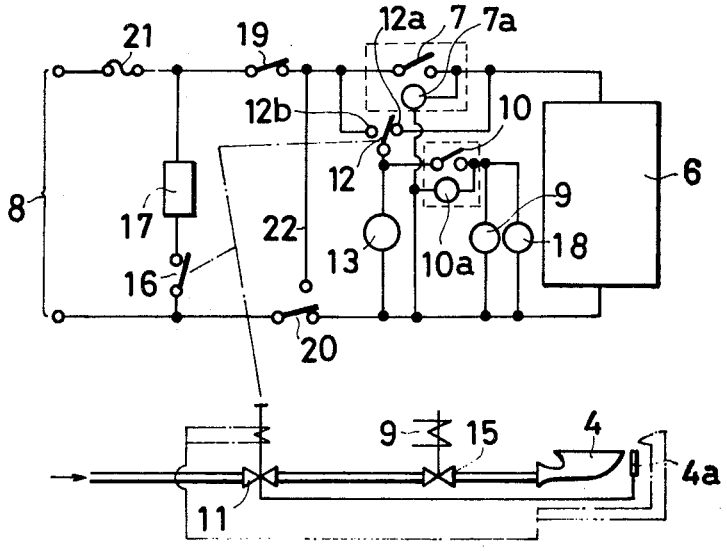
FIG. 2 is a circuit diagram showing a control circuit thereof.

As shown in FIG. 2, for instance, the gas heating means 4 is so constructed that the same may be supplied with gas through the gas cock 11 of pilot safety type and an electromagnetic control valve 15. It is contemplated that when the gas cock 11 is given an opening and ignition operation, a pilot burner **4*a* is supplied with gas and, at the same time, an ignition circuit 17 is connected to the electric power source 8 through an ignition switch 16 which is arranged to be operated in conjunction with the foregoing ignition operation. As a result, the pilot burner 4*a* is ignited, and when, thereafter, the second operation circuit 9 is energized through the switch 12 changed over in its connection to the second contact 12*b* side and through the second switch circuit 10, the electromagnetic control valve 15 is opened and thereby the gas heating means 4** is given a burning operation.

The first and the second switch circuits 7, 10 are composed of timer circuits which are arranged to be closed for predetermined periods by respective timer motors **7*a*, 10*a***.

Referring to the drawing, numeral 18 denotes a driving circuit for the circulation fan 14 which is connected in parallel with the second operation circuit 9. Numeral 19 denotes a lock switch arranged to be opened when a front door 1*a* of the heating chamber 1 is unlocked, and numeral 20 denotes a door switch which is arranged to be changed over in its connection when the front door 1*a* is opened to such a side, that it makes a short-circuit passage 22 to make ready a fuse 21 to break by fusion in the event of a fusion adhesion trouble with the lock switch 19.

In operation of the cooking device, when only the microwave heating means 3 is operated by closing of the first switch circuit 7, while the gas cock 11 remains inoperative, the switch 12 is connected to the first contact 12*a* side, so that the cooling fan 5 is driven for the operation period of the microwave heating means 3 determined by the first switch circuit 7. If, in addition, the second switch circuit 10 is also closed, the circulation fan 14 is also driven, whereby stagnation of the moisture in the heating chamber 1 can be prevented.

With this operation also, the electromagnetic control valve 15 is opened, but gas is not discharged because the gas cock 11 remains closed.

When the gas cock 11 is operated for carrying out the sole or joint operations of the two heating means 3, 4, the switch 12 is connected to the second contact 12*b* side, so that the cooling fan 5 is driven regardless of the joint operations or the sole operation. Additionally, even after the burning operation of the gas heating means 4 is stopped by opening of the second switch circuit 10, the driving of the cooling fan 5 is continued until when the gas cock 11 is closed. Consequently, the microwave heating means 3 can be protected from the heat of the interior of the heating chamber 1 which still has a high temperature for a while after stopping the burning operation.

Figure 3:
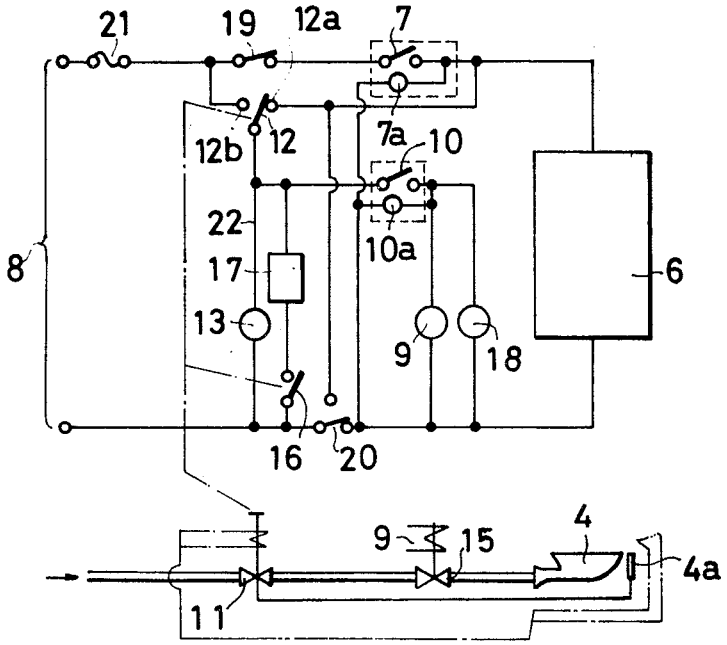
FIG. 3 is a circuit diagram showing another embodiment thereof.

In the foregoing example, as shown in FIG. 2, the second contact 12*b* of the switch 12 is connected to an intermediate portion between the first switch circuit 7 and the lock switch 19, but such a modification can be considered that the same is connected to an intermediate between the lock switch 19 and the electic power source 8 as shown, for instance, in FIG. 3. Additionally, in the foregoing example, as shown in FIG. 2, the ignition circuit 17 is connected to the electric power source 8 through the ignition switch 16 alone, but such a modification can be considered that, as shown in FIG. 3, for instance, the same is connected thereto through both the ignition switch 16 and the gang switch 12.

It is desirable that the gas cock 11 is provided with a controlling mechanism for effecting the opening and ignition operation thereof only when the front door 1*a* is opened, so that the degree of safety against explosion firing can be improved.

Thus, according to this invention, by using the switch 12 arranged to be moved with the gas cock 11, the cooling fan 5 is arranged to be driven in either case of a sole operation or joint (both) of the microwave heating means 3 and the gas heating means 4, so that the device can become simpler in construction than the conventional one using relay switches. In addition, in the case of operation of the gas heating means 4, even after the operation thereof is stopped, the cooling fan 5 keeps on driving and consequently the microwave heating means 3 can be securedly protected from the heat in the heating chamber 1.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. A heat cooking device of the type comprising: a cooking device main body having therein a heating chamber with microwave heating means; gas heating means and a cooling fan for said microwave heating means; a first operation circuit for operating said microwave heating means connected to an electric power source through a first switching circuit; a second operation circuit for operating said gas heating means connected to said electric power source through a second switching circuit and a switch arranged to be operated with a gas cock; a driving circuit for said cooling fan connected to said switch so as to be in parallel with a circuit connecting in series said second operation circuit and said second switching circuit; said switch having a first contact connected to said electric power source through said first switching circuit and having a second contact connected to said electric power source without passing through said first switching circuit and being arranged to be connected to said first contact when the gas cock is closed and to the second contact when the gas cock is opened.

2. A heat cooking device as defined in claim 1 wherein said microwave heating means and said cooling fan are located on the upper side of said heating chamber, said gas heating means comprising a gas burner on the lower side of said heating chamber.

3. A heat cooking device as defined in claim 1 including a lock switch arranged to be opened when a front door of said heating chamber is unlocked, said lock switch being in a circuit connected between said first switching circuit and said electric power source.

4. A heat cooking device as defined in claim 3 wherein said second contact of said switch is connected to an intermediate portion between said first switching circuit and said lock switch.

5. A heat cooking device as defined in claim 3 wherein said second contact of said switch is connected to an intermediate portion between said lock switch and said electric power source.

6. A heat cooking device as defined in claim 1 including ignition switch means; and ignition circuit means connected to said electric power source through said ignition switch means.

7. A heat cooking device as defined in claim 1 including ignition switch means; and ignition circuit means connected to said electric power source through said ignition switch means and said switch.

* * * * *